US010083661B2

(12) United States Patent
Maeda

(10) Patent No.: US 10,083,661 B2
(45) Date of Patent: Sep. 25, 2018

(54) ELECTROPHORETIC DISPLAY CONTROL DEVICE, ELECTROPHORETIC DISPLAY, ELECTRONIC APPARATUS, AND CONTROL METHOD

(71) Applicant: Seiko Epson Corporation, Tokyo (JP)

(72) Inventor: Hiroshi Maeda, Hara-mura (JP)

(73) Assignee: Seiko Epson Corporation, Tokyo (JP)

( * ) Notice: Subject to any disclaimer, the term of this patent is extended or adjusted under 35 U.S.C. 154(b) by 130 days.

(21) Appl. No.: 15/194,512

(22) Filed: Jun. 27, 2016

(65) Prior Publication Data

US 2017/0018236 A1 Jan. 19, 2017

(30) Foreign Application Priority Data

Jul. 14, 2015 (JP) ..... 2015-140446

(51) Int. Cl.
*G09G 3/34* (2006.01)

(52) U.S. Cl.
CPC ... *G09G 3/3446* (2013.01); *G09G 2300/0857* (2013.01); *G09G 2310/08* (2013.01); *G09G 2320/041* (2013.01); *G09G 2330/021* (2013.01)

(58) Field of Classification Search
None
See application file for complete search history.

(56) References Cited

U.S. PATENT DOCUMENTS

2008/0238867 A1 10/2008 Maeda et al.
2011/0261035 A1* 10/2011 Miyazaki ..... G09G 3/207 345/205

FOREIGN PATENT DOCUMENTS

JP 2008-268853 A 11/2008

* cited by examiner

*Primary Examiner* — Joseph Haley
(74) *Attorney, Agent, or Firm* — ALG Intellectual Property, LLC

(57) ABSTRACT

An electrophoretic display control device applies a first voltage to a first electrode and applies a second voltage to a second electrode during a display rewriting period in a display unit in which a dispersion liquid containing particles are arranged between the first electrode and the second electrode that is a pixel electrode, and applies a third voltage that is lower than the first voltage to the first electrode and applies a fourth voltage that is lower than the second voltage to the second electrode during a display retention period.

16 Claims, 5 Drawing Sheets

ELECTROPHORETIC DISPLAY CONTROL DEVICE, ELECTROPHORETIC DISPLAY, ELECTRONIC APPARATUS, AND CONTROL METHOD

BACKGROUND

1. Technical Field

The present invention relates to an electrophoretic display control device, an electrophoretic display, an electronic apparatus, and a control method.

2. Related Art

Electrophoretic displays (EPDs) are used for electronic paper or the like, for example.

JP-A-2008-268853 discloses an EPD formed of pixel circuits each having a driving thin film transistor (TFT), a static random access memory (SRAM), and a switch circuit.

Conventionally, EPDs have been used in such applications that involve less frequent rewriting and prioritize a good display retention property. For example, rewriting (switching) of a display occurs every one minute or so, and a power supply is turned off and a display content is maintained from a previous rewiring of a display to a current rewriting of the display. The response time in rewriting a display depends on the viscosity and therefore the moving speed of particles (for example, particles associated with white, particles associated with black, and the like) in a dispersion liquid. Conventionally, a dispersion liquid that contains particles having a low moving speed but a high retention property of a display has been used.

In recent years, however, in display devices employing an EPD, there has been an increasing demand for faster response time in rewriting a display by taking advantage of a high reflectivity property. As an example, in a wearable product using an EPD, there may be a case where a display is updated every second or less or there may be a case where a display is updated every minute or so in accordance with a situation where the product is used. In this case, while a dispersion liquid containing particles of a high moving speed is used, the retention property of a display decreases. With a lower retention property of a display, a display content easily varies compared to the case of a high retention property of a display, even with a short duration of application of an electric field. For example, when a low consumption drive is implemented by stopping a voltage application to pixel electrodes after the end of a display rewriting period, particles will move during a period of no voltage being applied resulting in a degenerated display image. Therefore, an EPD using a material of a low retention property requires more electric power to retain a display even for an update occurring every minute or so.

SUMMARY

As described above, in an electrophoretic display in particular, a low retention property of a display may result in a large power consumption in retaining a display.

An advantage of some aspects of the invention is that an electrophoretic display control device, an electrophoretic display, an electronic apparatus, and a control method that can reduce power consumption in retaining a display are provided.

One aspect of the invention is an electrophoretic display control device that applies a first voltage to a first electrode and applies a second voltage to a second electrode during a display rewriting period in a display unit in which a dispersion liquid containing particles are arranged between the first electrode and the second electrode that is a pixel electrode, and applies a third voltage that is lower than the first voltage to the first electrode and applies a fourth voltage that is lower than the second voltage to the second electrode during a display retention period.

According to this configuration, in the electrophoretic display control device, a lower voltage than that in a display rewriting period is applied to the first electrode and the second electrode during a display retention period. This allows for less power consumption in retaining a display in the electrophoretic display control device.

The electrophoretic display control device of one aspect of the invention may be configured such that the voltage applied to the first electrode and the voltage applied to the second electrode are constant voltages.

According to this configuration, constant voltages are applied to the first electrode and the second electrode in the electrophoretic display control device. This allows for less power consumption in retaining a display when constant voltages are applied to the first electrode and the second electrode in the electrophoretic display control device.

The electrophoretic display control device of one aspect of the invention may be configured such that (when constant voltages are applied to the first electrode and the second electrode) the second voltage is higher than the first voltage and the fourth voltage is higher than or equal to the third voltage.

According to this configuration, constant voltages as described above are applied to the first electrode and the second electrode in the electrophoretic display control device. This allows for less power consumption in retaining a display when constant voltages are applied to the first electrode and the second electrode in the electrophoretic display control device.

The electrophoretic display control device of one aspect of the invention may be configured such that the voltage applied to the first electrode is a pulsed voltage.

According to this configuration, a pulsed voltage is applied to the first electrode in the electrophoretic display control device. This allows for less power consumption in retaining a display when a pulsed voltage is applied to the first electrode in the electrophoretic display control device.

In the electrophoretic display control device of one aspect of the invention, a pulsed voltage of a first cycle may be applied as the first voltage during the display rewriting period, and a pulsed voltage of a second cycle that is different from the first cycle may be applied as the third voltage during the display retention period.

According to this configuration, the cycle of the pulsed voltage may be different between a display rewriting period and a display retention period when a pulsed voltage is applied to the first electrode in the electrophoretic display control device. This allows for less power consumption in retaining a display when a pulsed voltage is applied to the first electrode in the electrophoretic display control device.

In the electrophoretic display control device of one aspect of the invention, (when a pulsed voltage is applied to the first electrode) there may be a period where the second voltage is higher than the first voltage and there may be a period where the fourth voltage is higher than the third voltage.

According to this configuration, pulsed voltages as described above are applied to the first electrode in the electrophoretic display control device. This allows for less power consumption in retaining a display when a pulsed voltage is applied to the first electrode in the electrophoretic display control device.

In the electrophoretic display control device of one aspect of the invention, (when pulsed voltages are applied to the first electrode) the voltage applied to the second electrode may be a constant voltage.

According to this configuration, a constant voltage as described above is applied to the second electrode in the electrophoretic display control device. This allows for less power consumption in retaining a display when a pulsed voltage is applied to the first electrode and a constant voltage is applied to the second electrode in the electrophoretic display control device.

Another aspect of the invention is an electrophoretic display having any one of the above electrophoretic display control devices and the display unit.

According to this configuration, the electrophoretic display has the electrophoretic display control devices as described above and the display unit. This allows the electrophoretic display control device to reduce power consumption in retaining a display in the display unit.

Another aspect of the invention is an electronic apparatus having the electrophoretic display as described above.

According to this configuration, the electronic apparatus having the electrophoretic display as described above. This allows the electronic apparatus to reduce power consumption in retaining a display in the display unit of the electrophoretic display.

Another aspect of the invention is a control method of an electrophoretic display. The method includes applying a first voltage to a first electrode and applying a second voltage to a second electrode during a display rewriting period in a display unit in which a dispersion liquid containing particles are arranged between the first electrode and the second electrode that is a pixel electrode; and applying a third voltage that is lower than the first voltage to the first electrode and applying a fourth voltage that is lower than the second voltage to the second electrode during a display retention period.

According to this configuration, in the control method of the electrophoretic display, a voltage lower than that in a display rewriting period is applied to the first electrode and the second electrode during a display retention period. This allows the control method of the electrophoretic display to reduce power consumption in retaining a display.

As discussed above, according to the electrophoretic display control device, the electrophoretic display, the electronic apparatus, and the control method of the invention, a voltage lower than that in a display rewriting period is applied to the first electrode and the second electrode during a display retention period. This allows the electrophoretic display control device, the electrophoretic display, the electronic apparatus, and the control method of the invention to reduce power consumption in retaining a display.

BRIEF DESCRIPTION OF THE DRAWINGS

The invention will be described with reference to the accompanying drawings, wherein like numbers reference like elements.

DESCRIPTION OF EXEMPLARY EMBODIMENTS

Embodiments of the invention will be described in detail with reference to the drawings.

First Embodiment

Figure 1:
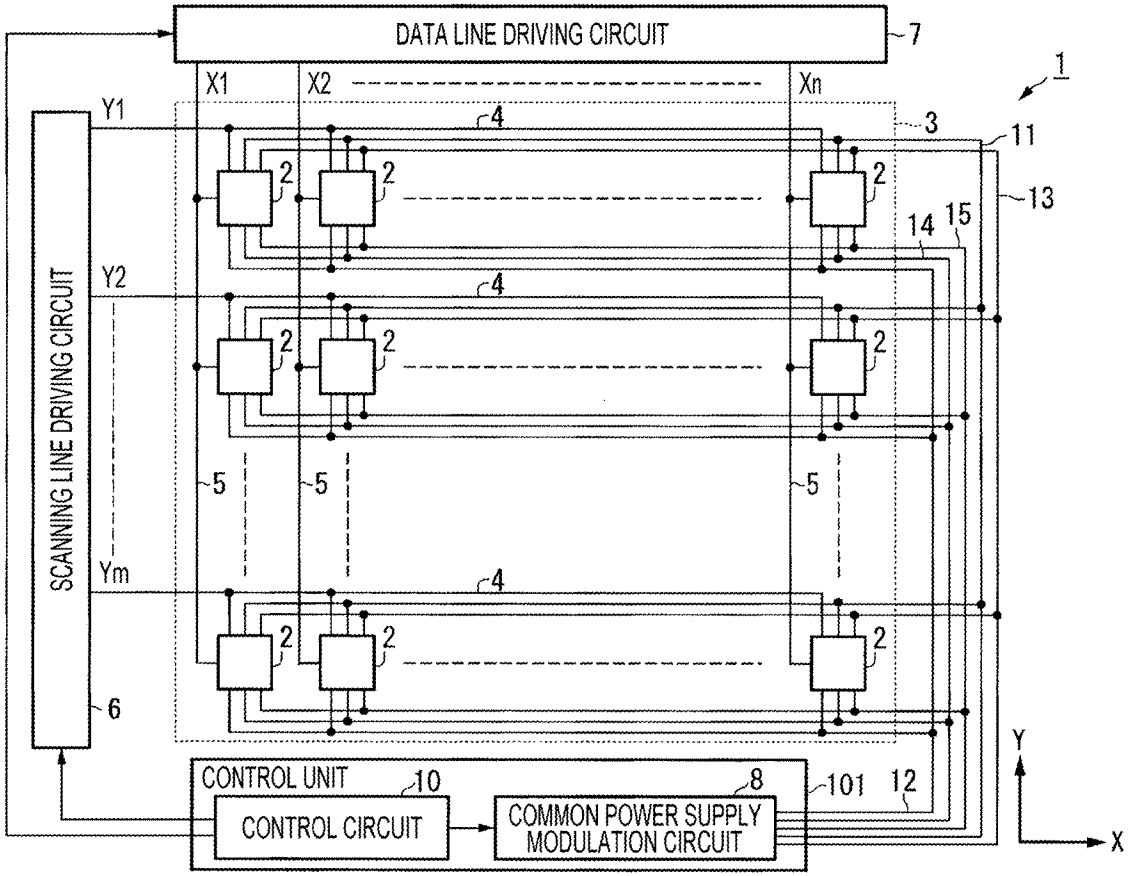
FIG. 1 is a diagram illustrating an exemplary configuration of an electrophoretic display according to one embodiment (a first embodiment) of the invention.

FIG. 1 is a diagram illustrating an exemplary configuration of an electrophoretic display 1 according to one embodiment (the first embodiment) of the invention. For the purpose of illustration, FIG. 1 depicts the X-axis and the Y-axis that are orthogonal to each other.

The electrophoretic display 1 includes a display unit 3, a scanning line driving circuit (a pixel driving unit) 6, a data line driving circuit (a pixel driving unit) 7, and a control unit 101. The control unit 101 includes a common power supply modulation circuit (a potential control unit) 8, and a control circuit 10.

In the display unit 3, pixels 2 are formed in a matrix of m in the Y-axis direction by n in the X-axis direction. In the present embodiment, m and n each are an integer of two or greater.

The scanning line driving circuit 6 is connected to the pixels 2 via a plurality of scanning lines 4 (Y1, Y2, . . . , Ym) extending in the X-axis direction in the display unit 3. N pixels 2 are connected to each scanning line 4.

The data line driving circuit 7 is connected to the pixels 2 via a plurality of data lines 5 (X1, X2, . . . , Xn) extending in the Y-axis direction in the display unit 3. M pixels 2 are connected to each data line 5.

The common power supply modulation circuit 8 is connected to the pixels 2 via a first control line 11, a second control line 12, a first power supply line 13, a second power supply line 14, and a common electrode power supply line 15. The scanning line drive circuit 6, the data line driving circuit 7, and the common power supply modulation circuit 8 are controlled by the control circuit 10. The control lines 11 and 12, the power supply lines 13 and 14, and the common electrode power supply line 15 are employed as shared lines in all the pixels 2.

In the present embodiment, the control unit 101 is configured by using an integrated circuit (IC), for example.

In the present embodiment, the common power supply modulation circuit 8 includes a step-up circuit, an oscillation circuit, and a switch circuit, for example. The step-up circuit steps up a voltage. The oscillation circuit generates pulses (a pulsed voltage in the present embodiment) based on a predetermined clock signal as a temporal reference. The switch circuit switches itself between input and output. Note that a pulsed voltage may be generated by the switch circuit alternatively switching two types of voltages (a high voltage and a low voltage) and, in this case, a function of the oscillation circuit may be implemented by the switch circuit.

Figure 2:
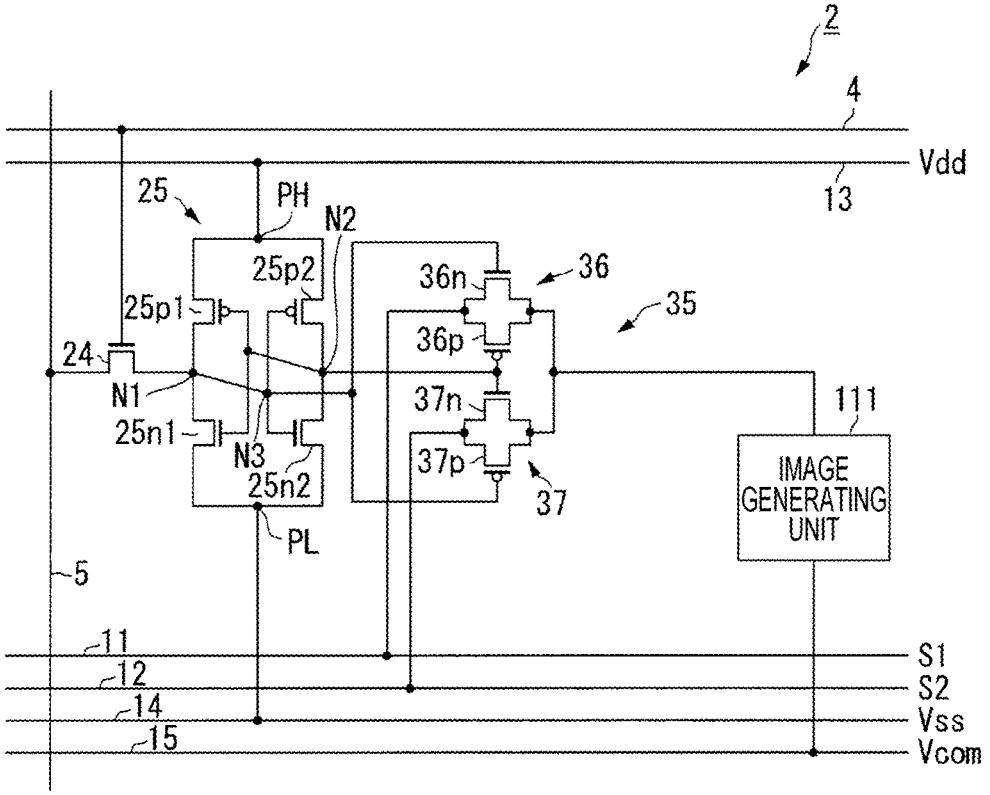
FIG. 2 is a diagram illustrating an exemplary configuration of a circuit of a pixel according to one embodiment (the first embodiment) of the invention.

FIG. 2 is a diagram illustrating an exemplary configuration of a circuit of one of the pixels 2 in one embodiment (the first embodiment) of the invention. In the present embodiment, each pixel 2 has the same circuit arrangement.

The pixel 2 has a driving TFT 24 (a pixel switching element), an SRAM 25 that is a memory circuit, a switch circuit 35, and an image generating unit 111. The image generating unit 111 includes a pixel electrode (a second electrode), a common electrode (a first electrode), and an electrophoretic dispersion liquid provided between the pixel electrode and the common electrode.

The driving TFT 24 is a negative metal oxide semiconductor (N-MOS). The gate, the source, and the drain of the driving TFT 24 are connected to the scanning line 4, the data line 5, and the SRAM 25, respectively. The driving TFT 24 inputs to the SRAM 25 an image signal that is input via the data line 5 from the data line scanning circuit 7 by connecting the data line 5 and the SRAM 25 to each other while a selection signal is input from the scanning line driving circuit 6 via the scanning line 4.

The SRAM 25 is formed of two positive metal oxide semiconductors (P-MOSs) 25*p*1 and 25*p*2 and two N-MOSs 25*n*1 and 25*n*2. The first power supply line 13 is connected to the sources of the P-MOSs 25*p*1 and 25*p*2, and the second power supply line 14 is connected to the sources of the N-MOSs 25*n*1 and 25*n*2. Therefore, the sources of the P-MOS 25*p*1 and the P-MOS 25*p*2 are higher-potential power supply terminals PHs of the SRAM 25, and the sources of the N-MOS 25*n*1 and the N-MOS 25*n*2 are lower-potential power supply terminals PLs of the SRAM 25.

The switch circuit 35 has a first transfer gate 36 and a second transfer gate 37.

The first transfer gate 36 has a P-MOS 36*p* and an N-MOS 36*n*.

The second transfer gate 37 has a P-MOS 37*p* and an N-MOS 37*n*.

The source of the first transfer gate 36 is connected to the first control line 11. The source of the second transfer gate 37 is connected to the second control line 12. Each of the drains of the transfer gates 36 and 37 is connected to a pixel electrode of the image generating unit 111.

The SRAM 25 has an input terminal N1 connected to the drain of the driving TFT 24, and a first output terminal N2 and a second output terminal N3 connected to the switch circuit 35.

The drain of the P-MOS 25*p*1 and the drain of the N-MOS 25*n*1 of the SRAM 25 function as the input terminal N1 of the SRAM 25. The input terminal N1 is connected to the drain of the driving TFT 24 and connected to the second output terminal N3 of the SRAM 25 (the gate of the P-MOS 25*p*2 and the gate of the N-MOS 25*n*2). Furthermore, the second output terminal N3 is connected to the gate of the N-MOS 36*n* of the first transfer gate 36 and the gate of the P-MOS 37*p* of the second transfer gate 37.

The drain of the P-MOS 25*p*2 and the drain of the N-MOS 25*n*2 of the SRAM 25 function as the first output terminal N2 of the SRAM 25. The first output terminal N2 is connected to the gate of the P-MOS 25*p*1 and the gate of the N-MOS 25*n*1 and connected to the gate of the P-MOS 36*p* of the first transfer gate 36 and the gate of the N-MOS 37*n* of the second transfer gate 37.

The SRAM 25 holds an image signal transmitted from the driving TFT 24 and inputs the image signal to the switch circuit 35.

The switch circuit 35 alternatively selects one of the first control line 11 and the second control line 12 based on an image signal input from the SRAM 25 and functions as a selector that connects the selected line to a pixel electrode of the image generating unit 111. At this time, only one of the first transfer gate 36 and the second transfer gate 37 operates based on the level of an image signal.

Specifically, in response to a high level (H) being input as an image signal to the input terminal N1 of the SRAM 25, a low level (L) is output from the first output terminal N2, the P-MOS 36*p* of the transistors connected to the first output terminal N2 is operated, and further the N-MOS 36*n* connected to the second output terminal N3 (the input terminal N1) is operated, and thereby the transfer gate 36 is driven. This causes the first control line 11 and the pixel electrode of the image generating unit 111 to be electrically connected.

On the other hand, in response to a low level (L) being input as an image signal to the input terminal N1 of the SRAM 25, a high level (H) is output from the first output terminal N2, the N-MOS 37*n* of the transistors connected to the first output terminal N2 is operated, and further the P-MOS 37*p* connected to the second output terminal N3 (the input terminal N1) is operated, and thereby the transfer gate 37 is driven. This causes the second control line 12 and the pixel electrode of the image generating unit 111 to be electrically connected.

Electrical conduction between the first control line 11 or the second control line 12 and a pixel electrode of the image generating unit 111 is achieved via one of the transfer gates 36 and 37 which is in operation, and a potential is input to the pixel electrode.

In the present embodiment, a first voltage signal S1 is applied to the first control line 11 and a second voltage signal S2 is applied to the second control line 12.

In the present embodiment, a voltage Vdd (Vdd>0) is applied to the first power supply line 13, a voltage Vss (Vss>0) is applied to the second power supply line 14, and a voltage Vcom (Vcom>0) is applied to the common electrode power supply line 15.

Figure 3:
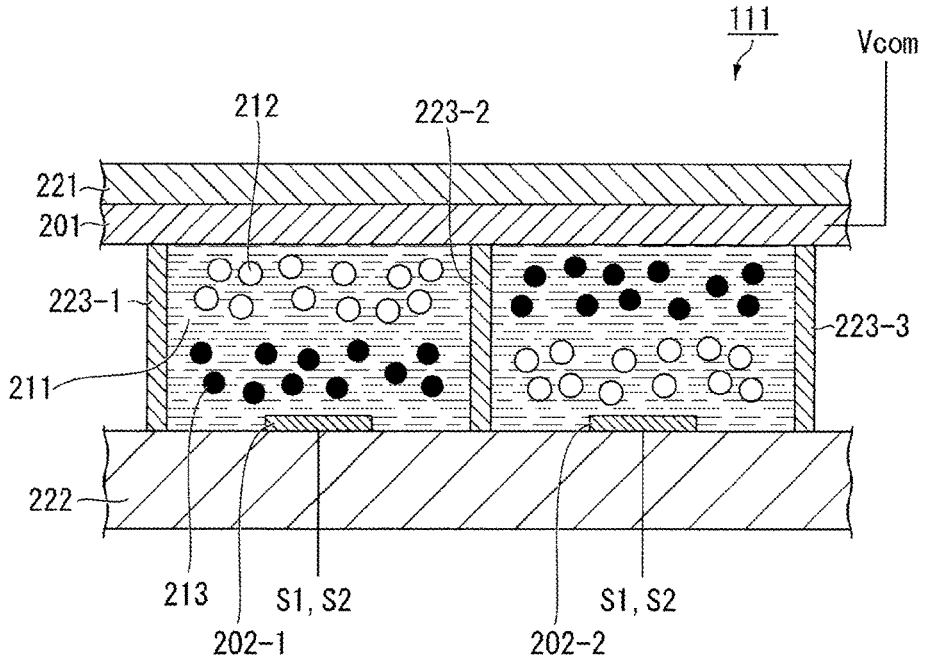
FIG. 3 is a diagram illustrating an exemplary configuration of an image generating unit according to one embodiment (the first embodiment) of the invention.

FIG. 3 is a diagram illustrating an exemplary configuration of an image generating unit 111 according to one embodiment (the first embodiment) of the invention. FIG. 3 is a partial sectional view of the image generating unit 111 of the electrophoretic display 1 (some of the pixels 2 of the display unit 3).

The image generating unit 111 has an opposing substrate 221, an element substrate 222, a plurality of spacer walls 223-1 to 223-3, a common electrode 201, a plurality of (in the present embodiment, m by n) pixel electrodes 202-1 and 202-2, a dispersion medium 211, a plurality of white particles 212, and a plurality of black particles 213. The dispersion medium 211, the white particles 212, and the black particles 213 form a dispersion liquid.

In this example, the white particles 212 are charged electrophoretic particles corresponding to white, and the black particles 213 are charged electrophoretic particles corresponding to black. The dispersion medium 211 is a liquid that disperses the white particles 212 and the black particles 213 therein.

The common electrode 201 is provided on one of the surfaces of the opposing substrate 221.

The pixel electrodes 202-1 and 202-2 are provided on one of the surfaces of the element substrate 222.

The element substrate 222 and the opposing substrate 221 are arranged to face each other such that the common electrode 201 and the pixel electrodes 202-1 and 202-2 are arranged inside.

An area between the element substrate 222 and the opposing substrate 221 is divided into a plurality of areas corresponding to respective pixels 2 by a plurality of spacer walls 223-1 to 223-3 provided between the element substrate 222 and the opposing substrate 221. Each area corresponding to a pixel 2 is provided with a single pixel electrode 202-1 or 202-2.

The element substrate 222 is a substrate made of glass or plastic, for example. The pixel electrodes 202-1 and 202-2 are formed on the element substrate 222. The pixel electrodes 202-1 and 202-2 are each formed in a rectangle for each pixel 2. Note that, although not illustrated, the scanning line 4, the data line 5, the first and second control lines 11 and 12, the power supply lines 13 and 14, the common electrode power supply line 15, the driving TFT 24, the SRAM 25, the switch circuit 35, and the like illustrated in FIG. 1 and FIG. 2 are formed between the pixel electrodes 202-1 and 202-2 or an underlying layer of the pixel electrodes 202-1 and 202-2 (a layer in the element substrate 222 side).

The opposing substrate 221 is a substrate arranged in the side where an image is displayed and having translucency, such as glass, for example. A material having translucency and conductivity, such as MgAg (magnesium silver), ITO (Indium Tin Oxide), IZO (Indium Zinc Oxide), or the like, for example, is used for the common electrode 201 formed on the opposing substrate 221. Note that, although a single common electrode 201 is employed in the present embodiment, a plurality of divided electrodes may be used instead of the common electrode 201 of the present embodiment as another exemplary configuration. These multiple electrodes may be provided for each pixel, for example.

One of the voltages of the signal S1 on the first control line 11 and the signal S2 on the second control line 12 is applied to each of the pixel electrodes 202-1 and 202-2 based on an image signal transmitted on the data line 5.

The common electrode 201 is connected to the common electrode power supply line 15. The voltage Vcom is applied to the common electrode 201.

In the image generating unit 111, an image is displayed on a pixel 2 basis according to a potential difference between the pixel electrodes 202-1 and 202-2 and the common electrode 201.

Examples of the dispersion medium 211 include water, alcoholic solvent such as methanol, ethanol, isopropanol, butanol, octanol, or methyl cellosolve, various esters such as ethyl acetate or butyl acetate, ketones such as acetone, methyl ethyl ketone, or methyl isobutyl ketone, aliphatic hydrocarbon such as pentane, hexane, or octane, alicyclic hydrocarbon such as cyclohexane or methylcyclo hexane, aromatic hydrocarbons such as benzene, toluene, benzenes having a long-chain alkyl group such as xylene, hexylbenzene, heptylbenzene, octylbenzene, nonylbenzene, decylbenzene, undecylbenzene, dodecylbenzene, or tridecylbenzene, tetradecylbenzene, halogenated hydrocarbon such as methylene chloride, chloroform, carbon tetrachloride, or 1,2-dichloroethane, carboxylate, and various other oils may be used alone or as compounds mixed with a surfactant or the like.

The white particles 212 are particles (high polymers or colloids) that consist of a white pigment such as titanium dioxide, zinc oxide, or antimony trioxide, for example, and are charged in a negative polarity, for example.

The black particles 213 are particles (high polymers or colloids) that consist of a black pigment such as aniline black or carbon black, for example, and are charged in a positive polarity, for example.

This configuration causes the white particles 212 and the black particles 213 to move in an electric field generated by a potential difference between the pixel electrodes 202-1 and 202-2 and the common electrode 201 in the dispersion medium 211.

Note that a charge control agent that consists of particles of electrolyte, surfactant, metallic soap, resin, rubber, oil, varnish, compound or the like, a dispersant agent such as a titanium coupling agent, an aluminate coupling agent, a silane coupling agent, a lubricant agent, a stabilizer, or the like may be added to the white pigment or the black pigment according to the necessity.

For example, a voltage is applied between the pixel electrodes 202-1 and 202-2 and the common electrode 201 such that a potential of the common electrode 201 becomes relatively higher. In response, the black particles 213 charged in a positive polarity are attracted to the pixel electrodes 202-1 and 202-2 side by Coulomb force. On the other hand, the white particles 212 charged in a negative polarity are attracted to the common electrode 201 side by Coulomb force. As a result, the white particles 212 are collected in a display surface side (the common electrode 201 side) and the color (white) corresponding to the white particles 212 is displayed on a display surface.

In contrast, a voltage is applied between the pixel electrodes 202-1 and 202-2 and the common electrode 201 such that a potential of the pixel electrode 202-1 and 202-2 becomes relatively higher. In response, the white particles 212 charged in a negative polarity are attracted to the pixel electrodes 202-1 and 202-2 side by Coulomb force. On the other hand, the black particles 213 charged in a positive polarity are attracted to the common electrode 201 side by Coulomb force. As a result, the black particles 213 are collected in a display surface side (the common electrode 201 side), and the color (black) corresponding to the black particles 213 is displayed on a display surface.

Note that the electrophoretic display 1 may display red, green, blue, or the like by replacing the pigments used for the white particles 212 and the black particles 213 with pigments of red, green, blue, or the like.

In the example of FIG. 3, for all the pixels 2, the voltage Vcom is applied to the common electrode 201, and different voltages are applied to the two neighboring pixel electrodes 202-1 and 202-2. Specifically, the first voltage signal S1 having a potential lower than the voltage Vcom of the common electrode 201 is applied to the pixel electrode 202-1 and thus the display color becomes white. On the other hand, the second voltage signal S2 having a potential higher than the voltage Vcom of the common electrode 201 is applied to the pixel electrode 202-2 and thus the display color becomes black.

Note that this is an example and each pixel 2 may have any display color.

Next, a driving method of the electrophoretic display 1 according to the present embodiment will be described with reference to FIG. 4 and FIG. 5.

Figure 4:
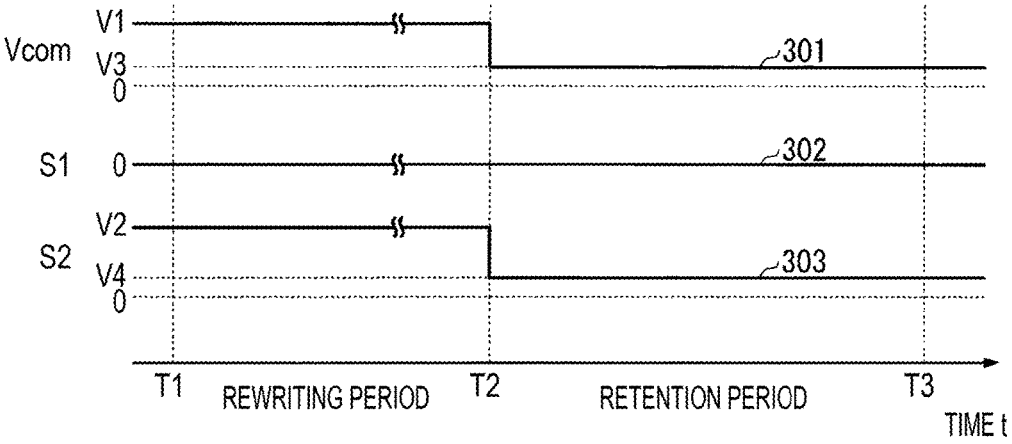
FIG. 4 is a diagram illustrating a timing chart of a first driving method according to one embodiment (the first embodiment) of the invention.

FIG. 4 is a diagram illustrating a timing chart of a first driving method according to one embodiment (the first embodiment) of the invention.

FIG. 4 illustrates a line 301 representing the voltage Vcom applied to the common electrode 201, a line 302 representing a voltage of the first voltage signal S1 applied to a pixel electrode (the pixel electrode 202-1 in the example of FIG. 4) when the display color is intended to be white, and a line 303 representing a voltage of the second voltage signal S2 applied to a pixel electrode (the pixel electrode 202-2 in the example of FIG. 4) when the display color is intended to be black. The horizontal axis of these graphs represents time t, and the vertical axes represent magnitudes (heights) of respective voltages.

A period between time T1 and time T2 (T2>T1>0) is a display rewriting period. A period between time T2 and time T3 (T3>T2) is a display retention period.

The display rewriting period is a period for rewriting the display color, which sets a duration from a start to a completion of movement of the white particles 212 and the black particles 213 when white and black are switched. This duration may be set in advance in accordance with a material of the image generating unit 111 or the like, for example. This duration may be an unchanged value (a fixed value) or may be a changeable value (a variable value).

As an example, since the viscosity of a dispersion liquid changes depending on temperature in general, the above duration may be changed in accordance with temperature. As a specific example, a sensor that detects a temperature and a table that stores a relation between a temperature and the duration may be provided and the duration corresponding to a temperature detected by the sensor may be read from the table.

A display retention period subsequent to a display rewriting period is a period for retaining the display color that has been rewritten in the display rewriting period. After a display retention period, the next display rewiring period occurs again and a set of a display rewriting period and a display retention period then repeatedly occurs in the same manner. The display retention period may be set to any duration. As an example, when a set of a display rewriting period and a display retention period periodically occurs, a time period obtained by subtracting the duration of a display rewriting period from one cycle is the duration of a display retention period. As a specific example, assuming that a set of a display rewriting period and a display retention period occurs every one second and the display rewriting period is 0.2 seconds, the display retention period will be 0.8 seconds.

Note that, since the present embodiment illustrates the case where a set of a display rewriting period and a display retention period periodically occurs in a constant cycle, a display rewriting period occurs even when a display is the same color before and after a rewriting of a display (white remains in white or black remains in black in the present embodiment), for example. In this case, when the display color is degenerated during a display retention period, for example, the same color (but not degenerated) can be recovered during a display rewriting period.

An example of FIG. 4 will be described.

During a display rewriting period, the control unit 101 continues to apply a constant voltage V1 (equal to Vcom) as the voltage Vcom of the common electrode 201. This voltage V1 is higher than 0 V.

During a display rewriting period, the control unit 101 continues to apply a constant 0 V (equal to a voltage of the signal S1) as a voltage of the signal S1 of the pixel electrode 202-1 providing a white display.

During a display rewriting period, the control unit 101 continues to apply a constant voltage V2 (equal to a voltage of the signal S2) as a voltage of the signal S2 of the pixel electrode 202-2 providing a black display. This voltage V2 is higher than the voltage V1.

During a display retention period, the control unit 101 continues to apply a constant voltage V3 (equal to Vcom) as the voltage Vcom of the common electrode 201. This voltage V3 is higher than 0 V and lower than the voltage V1.

During a display retention period, the control unit 101 continues to apply a constant 0 V (equal to a voltage of the signal S1) as a voltage of the signal S1 of the pixel electrode 202-1 providing a white display. That is, this voltage of the signal S1 is maintained at 0 V throughout a display rewriting period and a display retention period.

During a display retention period, the control unit 101 continues to apply a constant voltage V4 (equal to a voltage of the signal S2) as a voltage of the signal S2 of the pixel electrode 202-2 providing a black display. This voltage V4 is the voltage V3 or higher (that is, equal to or higher than the voltage V3). Further, the voltage V4 is lower than the voltage V2 in the present embodiment.

In this example, regarding a potential difference between the common electrode 201 and the pixel electrode 202-1 providing a white display, the common electrode 201 has a higher potential during a display rewriting period and a display retention period. This potential difference is larger in a display rewiring period, and therefore a display can be rewritten and the time required to rewrite a display is reduced. Further, this potential difference is smaller in a display retention period but is set to a sufficient potential difference for retaining a display. Further, since the voltage Vcom applied to the common electrode 201 is lower in a display retention period than in a display rewriting period, the consumption power required to retain a display can be reduced.

Regarding a potential difference between the common electrode 201 and the pixel electrode 202-2 providing a black display, the pixel electrode 202-2 has a higher potential during a display rewriting period. Further, regarding this potential difference, the pixel electrode 202-2 has a higher potential or the pixel electrode 202-2 and the common electrode 201 have the same potential (equal potential) during a display retention period. Since the voltage Vcom applied to the common electrode 201 and a voltage (a voltage of the signal S2) applied to the pixel electrode 202-2 are lower in a display retention period than in a display rewriting period, the consumption power required to retain a display can be reduced.

Note that a configuration in which the pixel electrode 202-2 and the common electrode 201 have the same potential during a display retention period does not provide an effect of changing a display back to an original state (changing a display back to a state of a rewriting period) and at least does not provide any effect of changing a display state (rewriting a display state to another state). In this configuration, a gradual degeneration of a display state during a display retention period does not manner.

Specifically, when a power supply voltage of the electrophoretic display 1 is 3 V, it is possible to set V1 to 15 V, V2 to 16 V, V3 to 3 V, and V4 to 3 V or 4 V. In this example, other different values may be used for the setting values of respective voltages as long as the relationships of relative height described above (relationships of relative magnitude including the values being equal) are maintained, for example. Further, instead of 0 V, a value higher than 0 V may be used.

Figure 5:
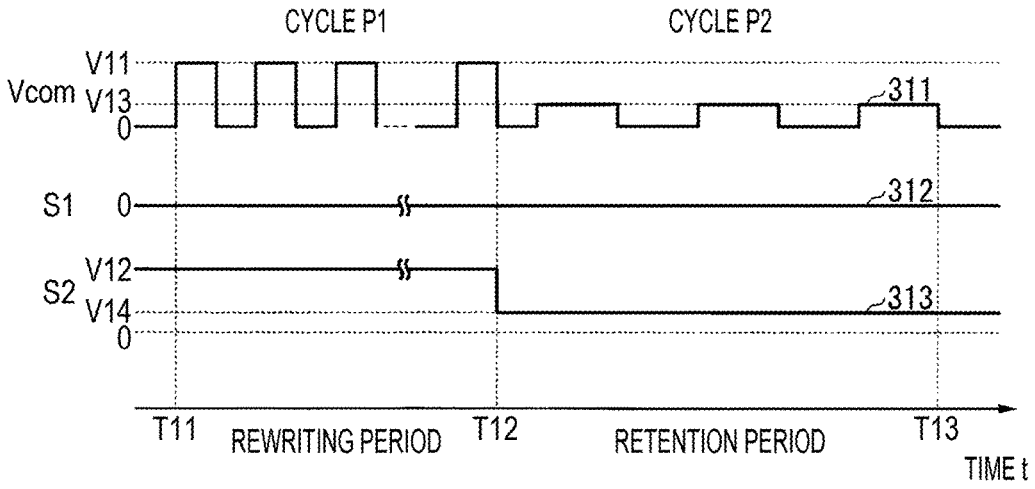
FIG. 5 is a diagram illustrating a timing chart of a second driving method according to one embodiment (the first embodiment) of the invention.

FIG. 5 is a diagram illustrating a timing chart of a second driving method according to one embodiment (the first embodiment) of the invention.

FIG. 5 illustrates a line 311 representing the voltage Vcom applied to the common electrode 201, a line 312 representing a voltage of the first voltage signal S1 applied to a pixel electrode (the pixel electrode 202-1 in the example of FIG.

5) when the display color is intended to be white, and a line 313 representing a voltage of the second voltage signal S2 applied to a pixel electrode (the pixel electrode 202-2 in the example of FIG. 5) when the display color is intended to be black. The horizontal axis of these graphs represents time t, and the vertical axes represent magnitudes (heights) of respective voltages.

A period between time T11 and time T12 (T12>T11>0) is a display rewriting period. A period between time T12 and time T13 (T13>T12) is a display retention period.

In this example, the functions of a display rewriting period and a display retention period are the same as those described in the first driving method illustrated in FIG. 4.

An example of FIG. 5 will be described.

During a display rewriting period, the control unit 101 continues to apply a pulsed voltage (equal to Vcom) having a maximum voltage of V11, a minimum voltage of 0 V, and a cycle of P1 (P1>0) as the voltage Vcom of the common electrode 201. This voltage V11 is higher than 0 V.

During a display rewriting period, the control unit 101 continues to apply a constant voltage of 0 V (equal to a voltage of the signal S1) as a voltage of the signal S1 of the pixel electrode 202-1 providing a white display.

During a display rewriting period, the control unit 101 continues to apply a constant voltage V12 (equal to a voltage of the signal S2) as a voltage of the signal S2 of the pixel electrode 202-2 providing a black display. This voltage V12 is the voltage V11 or higher (that is, equal to or higher than the voltage V11).

During a display retention period, the control unit 101 continues to apply a pulsed voltage V13 having the maximum voltage of V13, the minimum voltage of 0 V, and the cycle of P2 (P2>P1). This voltage V13 is higher than 0 V and lower than the voltage V11.

Note that, while the cycle P2 is longer than the cycle P1 in the present embodiment, the cycle P2 may be shorter than the cycle P1 in another exemplary configuration. Further, the cycle may not be changed between the periods, that is, the cycle P2 may be the same as the cycle P1 in another exemplary configuration.

During a display retention period, the control unit 101 continues to apply a constant voltage of 0 V (equal to a voltage of the signal S1) as a voltage of the signal S1 of the pixel electrode 202-1 providing a white display. That is, this voltage of the signal S1 is maintained at 0 V through a display rewriting period and a display retention period.

During a display retention period, the control unit 101 continues to apply a constant voltage V14 (equal to a voltage of the signal S2) as a voltage of the signal S2 of the pixel electrode 202-2 providing a black display. This voltage V14 is the voltage V13 or higher (that is, equal to or higher than the voltage V13). Further, the voltage V14 is lower than the voltage V12 in the present embodiment.

In this example, regarding a potential difference between the common electrode 201 and the pixel electrode 202-1 providing a white display, the common electrode 201 has a higher potential when a pulsed voltage of the common electrode 201 has the height of V11 or V13, and the common electrode 201 and the pixel electrode 202-1 have the same potential when a pulsed voltage of the common electrode 201 is 0 V, during a display rewriting period and a display retention period. This potential difference is greater than that in a display rewriting period, and therefore a display can be rewritten and the time required to rewrite a display can be reduced. Further, this potential difference is smaller in a display retention period but is set to a sufficient potential difference for retaining a display. Further, since the voltage Vcom applied to the common electrode 201 is lower in a display retention period than in a display rewriting period, the consumption power required to retain a display can be reduced.

Regarding a potential difference between the common electrode 201 and the pixel electrode 202-2 providing a black display, the pixel electrode 202-2 has the same potential as or a higher potential than the common electrode 201 when a pulsed voltage of the common electrode 201 has the height of V11 or V13, and the pixel electrode 202-1 has a higher potential when a pulsed voltage of the common electrode 201 is 0 V, during a display rewriting period and a display retention period. Further, since the voltage Vcom applied to the common electrode 201 and a voltage (a voltage of the signal S2) applied to the pixel electrode 202-2 are lower in a display retention period than in a display rewriting period, the consumption power required to retain a display can be reduced.

In the example of FIG. 5, the control unit 101 may include an oscillation circuit that provides oscillation in a pulsed signal with a variable frequency (for example, a high frequency and a low frequency) inside thereof (for example, in the inside of the common power supply modulation circuit 8), and may supply driving pulses to the common electrode 201 with varying the voltage of the pulse signal. When driving pulses of a low voltage and a low frequency as seen in the present embodiment are used, a circuit can be reduced in the size and the consumption power.

Note that a configuration in which there is a period (or a timing) where the pixel electrode 202-2 and the common electrode 201 have the same potential during a display retention period does not provide an effect of turning a display back to an original state (turning a display back to a state of a rewriting period) and at least does not provide any effect of changing a display state (rewriting a display state to another state). In such a configuration, a gradual degeneration of a display state during a display retention period does not manner.

Specifically, when a power supply voltage of the electrophoretic display 1 is 3 V, it is possible to set V11 to 15 V, V12 to 15 V or 16 V, V13 to 3 V, and V14 to 3 V or 4 V. In this example, other different values may be used for setting values of respective voltages as long as the relationships of the relative height described above (relationships of the relative magnitude including the values being equal) are maintained, for example. Further, instead of 0 V, a value higher than 0 V may be used.

In the examples of FIG. 4 and FIG. 5, while a constant voltage is used for voltages applied to the pixel electrodes 202-1 and 202-2 (except the time of switching voltages between a display rewriting period and a display retention period), a pulsed voltage may be used as a voltage applied to the common electrode 201 in the example of FIG. 5.

As described above, in the electrophoretic display 1 according to the present embodiment, regarding a voltage application to the common electrode 201 and a voltage application to a pixel electrode (the pixel electrode 202-2 in the examples of FIG. 4 and FIG. 5) that rewrites an image by using a higher voltage than a voltage of the common electrode 201, an electrophoretic display control device (for example, a device such as the control unit 101 having a driver IC and the like) continues to apply a lower voltage in a subsequent retention period than in a rewriting period of the display unit 3 (for example, a panel).

Therefore, in the electrophoretic display 1 according to the present embodiment, even when a display panel in which a dispersion liquid containing electrophoretic particles (the white particles 212 and the black particles 213 in the present embodiment) has a low retention property is used, a dispersion state of the electrophoretic particles after a rewriting of an image can be maintained with low consumption power, and thereby a displayed image can be maintained. The electrophoretic display 1 according to the present embodiment can achieve a long time retention and enhance the retention property to maintain a display quality, even when a low retention material is used for the display unit 3, for example.

Although the case where two types of electrophoretic particles are used has been illustrated in the present embodiment, one type of electrophoretic particles may be used or three or more types of electrophoretic particles may be used as another exemplary configuration.

Further, although the case where the spacer walls 223-1 to 223-3 having a shape illustrated in FIG. 3 are provided in the image generating unit 111 has been illustrated in the present embodiment, spacer walls having a different shape may be used. Further, although the spacer walls partitioning a dispersion liquid into every single pixel electrode of the pixel electrodes 202-1 and 202-2 are provided in the present embodiment, spacer walls partitioning a dispersion liquid into every two or more pixel electrodes may be provided as another exemplary configuration.

Further, although spacer walls partitioning a dispersion liquid are used in the present embodiment, capsules containing a dispersion liquid may be used as another exemplary configuration.

Modified Examples

Although a nine-Tr circuit (a circuit having nine transistors) illustrated in FIG. 2 is used to form each pixel 2 in the present embodiment, instead, a one-T-one-C circuit (a circuit having one transistor and one capacitor) may be used to form each pixel 2 as another example.

Second Embodiment

Figure 6A:
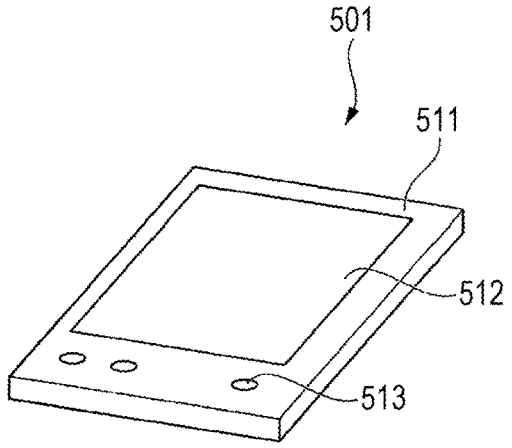
FIG. 6A is a schematic diagram illustrating an exemplary configuration of an electronic apparatus according to an embodiment (a second embodiment) of the invention.
Figure 6B:
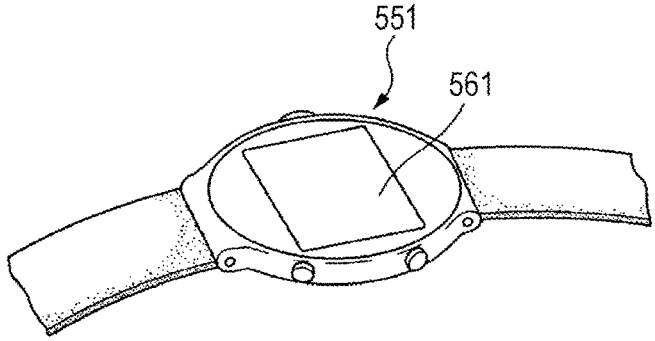
FIG. 6B is a schematic diagram illustrating an exemplary configuration of an electronic apparatus according to an embodiment (the second embodiment) of the invention.
Figure 6C:
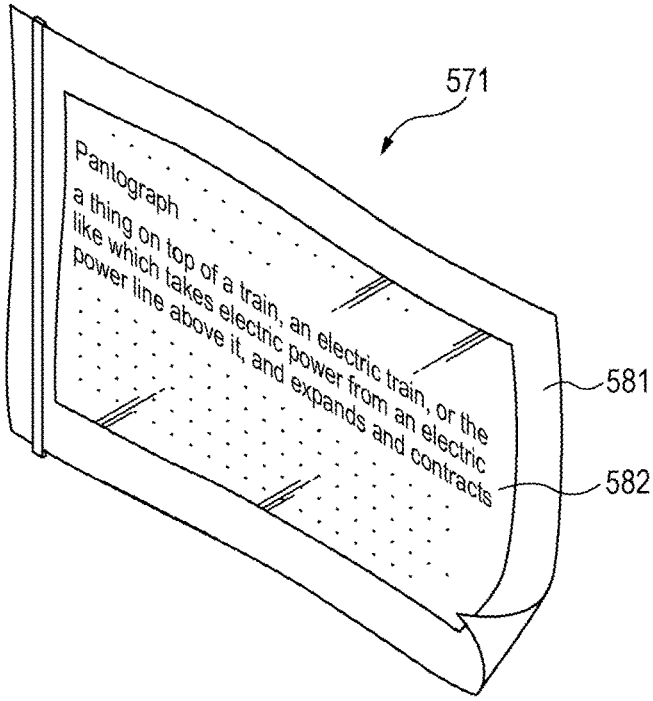
FIG. 6C is a schematic diagram illustrating an exemplary configuration of an electronic apparatus according to an embodiment (the second embodiment) of the invention.

FIG. 6 A to FIG. 6C are schematic diagrams illustrating exemplary configuration of an electronic apparatus according to an embodiment (a second embodiment) of the invention. The present embodiment illustrates an electronic apparatus to which the electrophoretic display 1 according to the above embodiment is applied.

FIG. 6A is a perspective view illustrating an electronic book 501 as an example of an electronic apparatus.

The electronic book 501 has a book-shaped frame 511, a display unit 512 to which the electrophoretic display 1 according to the above embodiment is applied, and an operating unit 513.

FIG. 6B is a perspective view illustrating a wrist watch 551 as an example of an electronic apparatus.

The wrist watch 551 has a display unit 561 to which the electrophoretic display 1 according to the above embodiment is applied.

FIG. 6C is a perspective view illustrating electronic paper 571 as an example of an electronic apparatus.

The electronic paper 571 has a main unit 581 formed of a flexible rewritable sheet having a feel of a material similar to paper and a display unit 582 to which the electrophoretic display 1 according to the above embodiment is applied.

Note that the electrophoretic display 1 according to the above embodiment may be applied to other various electronic apparatuses, which may be, for example, a display unit of an electronic apparatus such as a cellar phone, a portable audio apparatus, or the like, a business use sheet such as a manual, a text book, an exercise book, an information sheet, or the like.

As discussed above, the electronic apparatus according to the present embodiment allows for the same advantages as those in the electrophoretic display 1 according to the above embodiment.

Summary of Embodiments

As one exemplary configuration, in an electrophoretic display control device (a device including the control unit 101 in the present embodiment), during a display rewriting period in the display unit 3 in which a dispersion liquid containing particles (the white particles 212 and the black particles 213 in the present embodiment) are arranged between a first electrode (the common electrode 201 in the present embodiment) and a second electrode that is a pixel electrode (the pixel electrodes 202-1 and 202-2 in the present embodiment), a first voltage (the voltage Vcom during a rewriting period in the examples of FIG. 4 and FIG. 5) is applied to the common electrode 201 and a second voltage (a voltage of the signal S2 during a rewriting period in the examples of FIG. 4 and FIG. 5) is applied to the pixel electrode (the pixel electrode 202-2 in the examples of FIG. 4 and FIG. 5) and, during a display retention period, a third voltage (the voltage Vcom during a retention period in the examples of FIG. 4 and FIG. 5) that is lower than the first voltage to the common electrode 201 and a fourth voltage (a voltage of the signal S2 during a retention period in the examples of FIG. 4 and FIG. 5) that is lower than the second voltage to the pixel electrode (the pixel electrode 202-2 in the examples of FIG. 4 and FIG. 5). Note that the number of types of the particles is at least one.

As one exemplary configuration, the voltage applied to the common electrode 201 and the voltage applied to the pixel electrode are constant voltages in the electrophoretic display control device (the example of FIG. 4).

As one exemplary configuration, the second voltage is higher than the first voltage, and the fourth voltage is higher than or equal to the third voltage in the electrophoretic display control device (the example of FIG. 4).

As one exemplary configuration, the voltage applied to the common electrode 201 is a pulsed voltages in the electrophoretic display control device (the example of FIG. 5).

As one exemplary configuration, a pulsed voltage of a first cycle (the cycle P1 in the example of FIG. 5) is applied as the first voltage in a display rewriting period, and a pulsed voltage of a second cycle (the cycle P2 in the example of FIG. 5) that is different from the first cycle is applied as the third voltage in a display rewriting period.

As one exemplary configuration, there is a period (or a timing) where the second voltage is higher than the first voltage and there is a period (or a timing) where the fourth voltage is higher than the third voltage in the electrophoretic display control device (the example of FIG. 5).

As one exemplary configuration, the electrophoretic display 1 has the electrophoretic display control device as described above and the display unit 3.

As one exemplary configuration, an electronic apparatus has the electrophoretic display 1 as described above (the examples of FIG. 6A, FIG. 6B, and FIG. 6C).

As one exemplary configuration, in a control method of an electrophoretic display, the control method includes, during a display rewriting period in a display unit in which a dispersion liquid containing particles are arranged between a common electrode and a pixel electrode, applying a first voltage to the common electrode and applying a second voltage to the pixel electrode and, during a display retention period, applying a third voltage that is lower than the first voltage to the common electrode and applying a fourth voltage that is lower than the second voltage to the pixel electrode.

Although the embodiments of the invention have been described above with reference to the drawings, the specific configurations are not limited to these embodiments and may include designs and the like within the scope not departing from the spirit of the invention.

Note that a program for implementing a function of any component (for example, the control unit 101 or the like) in the devices described above (for example, the electrophoretic display control device, the electrophoretic display 1, or the electronic apparatus) may be recorded (stored) in a computer readable recording medium (a storage medium) and executed by loading the program in a computer system. Note that "computer system" as used herein includes operating system (OS) or hardware such as a peripheral apparatus or the like. Further, "computer readable recording medium" refers to a portable medium such as a flexible disk, an optical magnetic disk, a read only memory (ROM), a compact disk (CD)-ROM, or the like or a storage device such as a hard disk or the like incorporated in a computer system. Furthermore, "computer readable recording medium" includes a medium that holds a program for a certain time period, such as a non-volatile memory (a random access memory (RAM)) inside a computer system that serves as a server or a client when a program is transmitted via a network such as the Internet or a communication line such as a telephone line.

Further, the program described above may be transmitted via a transmission medium or over a transmission wave in a transmission medium from a computer system storing this program in a storage device or the like. As used herein, "transmission medium" transmitting a program refers to a medium having a function of transmitting information, such as a network such as the Internet or the like or a communication line such as a telephone line or the like.

Further, the program described above may be a program for implementing a part of the functions described above. Furthermore, the program described above may be a so-called differential file (a differential program) that can be implemented as a combination with a program in which the functions described above have already been stored.

The entire disclosure of Japanese Patent Application No. 2015-140446, filed Jul. 14, 2015 is expressly incorporated by reference herein.

What is claimed is:

1. An electrophoretic display control device comprising:
a control circuit configured to:
apply a first voltage to a first electrode and apply a second voltage to a second electrode during a display rewriting period in a display unit in which dispersion liquid containing particles are arranged between the first electrode and the second electrode that is a pixel electrode; and
apply a third voltage that is lower than the first voltage to the first electrode and apply a fourth voltage that is lower than the second voltage to the second electrode during a display retention period,
wherein
there is a period where the second voltage is higher than the first voltage, and
there is a period where the fourth voltage is higher than the third voltage.

2. The electrophoretic display control device according to claim 1, wherein at least one of the first and third voltages applied to the first electrode and at least one of the second and fourth voltages applied to the second electrode are constant voltages.

3. The electrophoretic display control device according to claim 1, wherein at least one of the first and third voltages applied to the first electrode is a pulsed voltage.

4. The electrophoretic display control device according to claim 3,
wherein, during the display rewriting period, a pulsed voltage of a first cycle is applied as the first voltage, and
wherein, during the display retention period, a pulsed voltage of a second cycle that is different from the first cycle is applied as the third voltage.

5. The electrophoretic display control device according to claim 3, wherein at least one of the second and fourth voltages applied to the second electrode is a constant voltage.

6. An electrophoretic display comprising:
the electrophoretic display control device according to claim 1; and
the display unit.

7. An electrophoretic display comprising:
the electrophoretic display control device according to claim 2; and
the display unit.

8. An electrophoretic display comprising:
the electrophoretic display control device according to claim 3; and
the display unit.

9. An electrophoretic display comprising:
the electrophoretic display control device according to claim 4; and
the display unit.

10. An electrophoretic display comprising:
the electrophoretic display control device according to claim 5; and
the display unit.

11. An electronic apparatus comprising the electrophoretic display according to claim 6.

12. An electronic apparatus comprising the electrophoretic display according to claim 7.

13. An electronic apparatus comprising the electrophoretic display according to claim 8.

14. An electronic apparatus comprising the electrophoretic display according to claim 9.

15. A control method of an electrophoretic display, the control method comprising:
applying a first voltage to a first electrode and applying a second voltage to a second electrode during a display rewriting period in a display unit in which a dispersion liquid containing particles is arranged between the first electrode and the second electrode that is a pixel electrode; and
applying a third voltage that is lower than the first voltage to the first electrode and applying a fourth voltage that is lower than the second voltage to the second electrode during a display retention period,
wherein
there is a period where the second voltage is higher than the first voltage, and
there is a period where the fourth voltage is higher than the third voltage.

16. An electrophoretic display control device comprising:
a control circuit configured to:
apply a first voltage to a first electrode and apply a second voltage to a second electrode during a display rewriting period in a display unit in which dispersion liquid containing particles are arranged between the first electrode and the second electrode that is a pixel electrode; and apply a third voltage that is lower than the first voltage to the first electrode and apply a fourth voltage that is lower than the second voltage to the second electrode during a display retention period, wherein during the display rewriting period, a pulsed voltage of a first cycle is applied as the first voltage, and during the display retention period, a pulsed voltage of a second cycle that is different from the first cycle is applied as the third voltage.

* * * * *